US005643100A

United States Patent [19]

Zabytko et al.

[11] Patent Number: 5,643,100

[45] Date of Patent: Jul. 1, 1997

[54] GOLF PUTTER

[76] Inventors: Luanne Byers Zabytko, 1711 Cleaver La., Wilmington, Del. 19803-4003; Nyra W. Whelchel, 1323 W. 10th St., Wilmington, Del. 19806; George W. Dougherty, Jr., 100 Dayett Mills Rd., Newark, Del. 19702; Sharon K. Bockover, 4030 N. Pomona Rd., Tucson, Ariz. 85705

[21] Appl. No.: 432,829

[22] Filed: May 2, 1995

[51] Int. Cl.[6] ..... A63B 53/04; A63B 69/36

[52] U.S. Cl. ..... 473/250; 473/252; 473/335; 473/340; 473/329; 273/DIG. 16

[58] Field of Search ..... 273/167 R, 97 R, 273/167 J, 164.1, 167 A, 167 H, 169, 167 F, 170, 171, 172, 173, DIG. 16, 78, 175; 473/335, 238, 250–252, 340, 338, 329

[56] References Cited

U.S. PATENT DOCUMENTS

| | | | |
|---|---|---|---|
| 1,666,174 | 4/1928 | Holland | 473/251 |
| 2,491,383 | 12/1949 | Liolich | 273/167 A |
| 2,957,696 | 10/1960 | Warpotas | 273/164.1 |
| 3,143,349 | 8/1964 | MacIntyre | 473/338 |
| 3,836,153 | 9/1974 | Dance | 273/173 |
| 3,881,733 | 5/1975 | Csernits | 273/167 R |
| 3,955,819 | 5/1976 | Yokich | 273/164.1 |
| 4,325,550 | 4/1982 | Thompson | 273/167 A |
| 4,568,088 | 2/1986 | Kurahashi | 273/169 |
| 4,832,344 | 5/1989 | Werner | 473/251 |
| 5,083,778 | 1/1992 | Douglass . | |
| 5,324,031 | 6/1994 | Green | 273/78 |

OTHER PUBLICATIONS

The DuPont Merchandise Collection, 1994, p. 16, publ. Geiger Bros., Mt Hope Ave., Lewistown, ME 04241.

The Golfsmith Catalog, 1995, pp. 74–81, publ. Golfsmith International, Inc., 1100 North IH-35, Austin, TX 78753.

Advertisement: Odyssey Putter w/ Stronomic Inlay on Putter Face.

*Primary Examiner*—Sebastiano Passaniti

[57] ABSTRACT

A golf putter with a novel head design consists of solid materials laminated horizontally to yield a single surface alignment aid on the surface that strikes the golf ball (the front face/face). Optional alignment markings on the top surface of the putter, centered over the point on the face where there in minimal torque when the head strikes the golf ball ("sweet spot"), combine with the single surface alignment aid on the face to form a single surface two-dimensional alignment system. The resilient nature of the solid materials used for the preferred embodiment of this putter head imparts a softer "feel" to the golfer, reduces skid of the ball after the ball is struck, and produces a lightweight club, allowing the golfer to use a fuller complete stroke for each putt, thereby improving precision and accuracy from putt to putt. The sole of the putter head is curved upward from the center of the head toward the heel and toe to decrease friction and resistance from contact with the grass or ground as the putter head swings away from and through the ball during the putting stroke. Lead or alloy weights may be added through a cavity to optimize the weight and balance. Milling the face improves the contact point between the face and the golf ball.

19 Claims, 6 Drawing Sheets

GOLF PUTTER

BACKGROUND OF THE INVENTION

This invention relates to golf clubs and more particularly to a putter that uses a solid material for the putter head which allows novel design improvements and imparts a softer "feel" to the putt, thereby enhancing the precision and accuracy of the golfer's putting stroke.

The game of golf consists of the "long game" and the "short game." The short game consists of chip shots less than 100 yards in length and putting on or around the putting surface (green). The sport offers a variety of equipment to fit the needs of players at different skill levels. For example, golf balls are available in hard cover and soft cover (balata) forms. The hard cover balls are more durable and provide longer distance for the golfer's long game versus the balata ball. For these same reasons, the hard cover balls are more difficult to control in the short game and around and on the green because they quickly rebound off the club face, tending to be more lively or "hot," and offering less control than a balata ball. As a result, the amateur golfer who needs to play a hard cover ball to maximize distance for the long game has to sacrifice strokes in the short game and shoot a higher score. Although the balata balls are preferable for the short game, they are less desirable to the amateur golfer to use because they carry a comparably shorter distance than the hard cover balls in the long game and also are easily cut or mutilated if mis-hit by the golf club. Furthermore, the Rules of Golf do not permit a golfer to use two different types of balls between shots unless he or she uses a new ball every time the ball is replaced. This practice is impractical and costly.

One alternative is to use a club that will produce a softer "feel" to the stroke and more control of the putt when the golfer uses a hard cover ball. Since putting is one part of the short game requiring a high degree of control over the stroke, this invention is a putter that uses a solid material that is softer than conventional putter heads in the preferred embodiment. Other putters (Odyssey, graphite heads, U.S. Pat. No. 5083778) attempted to achieve this objective, but in these cases, the materials do not lend themselves to improvements to the putter head design which enhance the golfer's alignment of the putt, thereby further contributing to improvement of putting results.

When putting, the golfer must properly align the putter so that the point of impact of the putter face against the golf ball is directed toward the target. Numerous putter designs have lines, grooves, or other markings on top of the club to optimize this alignment. Two additional components of alignment that are also important are the position of the hands over the ball and the position of the putter face perpendicular to the line of the putt (also known as "squareness" of the putter face). Existing putters do not combine putter face and putter top markings for alignment without violating the single solid surface integrity of the putter face. That is, putters with engraved grooves, painted lines and inlays on the putter face do not have a single solid surface face. These alterations to the face affect the "feel" and responsiveness of the putt.

SUMMARY OF THE INVENTION

An object of the present invention is to provide a putter which allows the player to align the putter face, the hand position, and the "sweet spot" to the ball in order to increase the precision and accuracy of the golf shot.

Another object of the putter is to provide optimal swing weight for the club. An optimal weight allows the golfer to fully stroke through the ball, obtaining a truer roll and line toward the hole on the green without generating too much force at impact.

Yet another object of the putter is to provide a club that does not drag along the putting surface during the back swing and stroke. Dragging the putter along the putting surface can take the club off-line and decelerate the stroke through the ball. Minimizing the contact of the sole of the putter head with the putting surface will allow for a complete, clean stroke and improve the chances for a good putt.

A further objective is to provide a putter head that has a "softer feel" than a metal putter head when striking the ball. Reducing the ball rebound off the face will minimize skidding of the ball and allow it to stay true to the line of the putt. A "softer feel" also instills more confidence to the golfer, which decreases the propensity for the player to "quit on the stroke."

In accordance with these objectives, the present invention provides a putter head that includes a visible horizontal line in the center of the front face. The face consists of a single solid surface. The horizontal line is visible only when the putter head and the golfer's hands are positioned correctly to the ball. This visible horizontal line in the center of the front face forms a single-surface alignment aid. In addition, an optional inlaid line on the top of the club may be inserted to form a 90° angle to the visible horizontal line when the putter head and the golfer's hands are in the correct position for the putt. The combination of these markings from two different surfaces or planes of the putter head produces a putter with a single surface two dimensional alignment aid.

The present invention is designed to optionally allow addition of weight to a cavity in the head, through a cavity that is drilled/carved into any surface that does not strike the golf ball. In the preferred embodiment, the cavity is drilled and located in the middle of the sole on the putter head. Adjustment of the swing weight allows the putter to have enough mass to generate a good roll to the ball without making the putter too heavy.

In this invention, the sole of the putter head may optionally be curved to minimize the point of contact between the sole of putter head and the putting surface.

In one embodiment, the putter head is made from DuPont CORIAN®. This material has a "softer feel" to the golfer than metal when he or she strikes the ball but is of sufficient hardness to impart roll to the ball.

Briefly, the present invention relates to a golf putter which has a single surface striking face which generally is vertically oriented. The single striking surface is comprised of solid materials assembled to form a visible horizontal straight line in the center of the face. The loft imparted to the face of the club provides the golfer with a visual perception of a thin solid line when the hands of the golfer are holding the club and correctly positioning the putter over the ball at address. Markings on the top of the putter head may optionally be positioned over the "sweet spot" to form a visually perceived 90° angle to the visually perceived horizontal line on the face of the putter head when the hands of the golfer are holding the club and correctly positioning the putter over the ball and toward the target at address. The combination of these markings from two different surfaces or planes of the putter head produces a putter with a visually perceived single surface two dimensional alignment aid. The putter also has a cavity for insertion of weight, such as lead or a similar alloy, of greater density than the material used for the putter head, to allow optimization of the swing weight needed for generating a good roll to the ball. Insertion of the weight behind the "sweet spot" reduces the face deflection upon impact by enlarging the size of the "sweet spot." The putter head may be shaped on the bottom or sole in an arcuate fashion to reduce the chance of the putter head dragging along or striking the putting surface during a mis-hit putting stroke. This configuration of the sole provides the golfer with an improved chance of properly putting the ball resulting in a reduced chance of the putter head being deflected off-line. The use of material for the preferred embodiment of the putter head that is softer than conventional materials used for putter heads produces a putter with a "softer feel." A "softer feel" enables the golfer to take a full, complete putting stroke, resulting in an accurate on-line shot with minimal skidding and acceptable ball speed on the putting surface.

The advantage of this invention will become apparent from the description which follows and accompanies the drawings.

DETAILED DESCRIPTION

Figure 1:
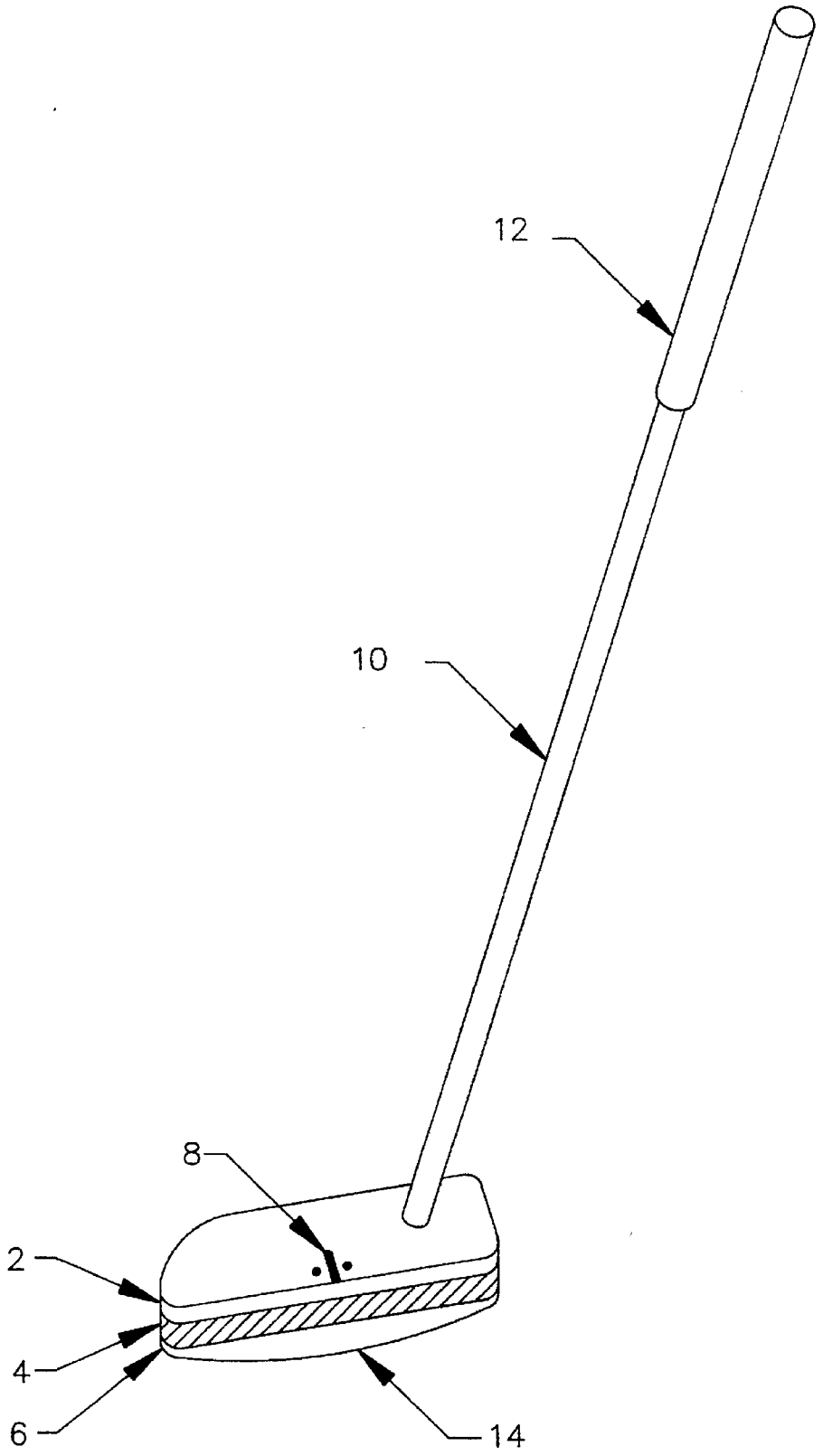
FIG. 1 is a view of the full putter.

FIG. 1 illustrates a putter having a shaft 10 with a gripping portion 12 attached to one end of the shaft using adhesive or other means known to those skilled in the art and are as such considered to be within the purview of the present invention. At the other end of the shaft is the putter head 2 through 6 which is attached using adhesive or other means known to those skilled in the art and are as such also considered to be within the purview of the present invention. In the preferred embodiment, a cavity is drilled/carved into the top of the putter head, near the face, between the sweet spot and the heel of the putter head to accommodate the external diameter of a shaft. The cavity in the preferred embodiments is drilled/carved from the top into the middle of the putter head to create an angle of lie for the shaft that measures 70°, 72°, or 74° from the heel-toe horizontal plane that is tangential to the top of the putter head.

FIG. 2 through FIG. 6 illustrate a preferred embodiment of a putter head 2 though 6 of the present invention which has an object, among others, the design of a single surface two dimensional alignment system for putting. Prior art contains markings on top of putter heads which enable the golfer to align the hand position and club face position using parallax. Other prior art is available with grooves, engraving, and/or applied markings on the face of the putter head which allow the golfer to "line-up" a putt. In these inventions, the integrity of the putter face is in some way violated, which can affect the true point of contact between the ball and the club face. Such violations in integrity can produce laterally deflected rebounding forces causing the ball to deflect off the true line of the putt, thereby negating any benefit of an alignment system on the face of the putter head. The single surface one or two dimensional alignment system of the present invention maximizes the potential for proper alignment of the shot yet minimizes the chances for the shot to be deflected because of any irregularities on the face of the putter head.

Figure 2:
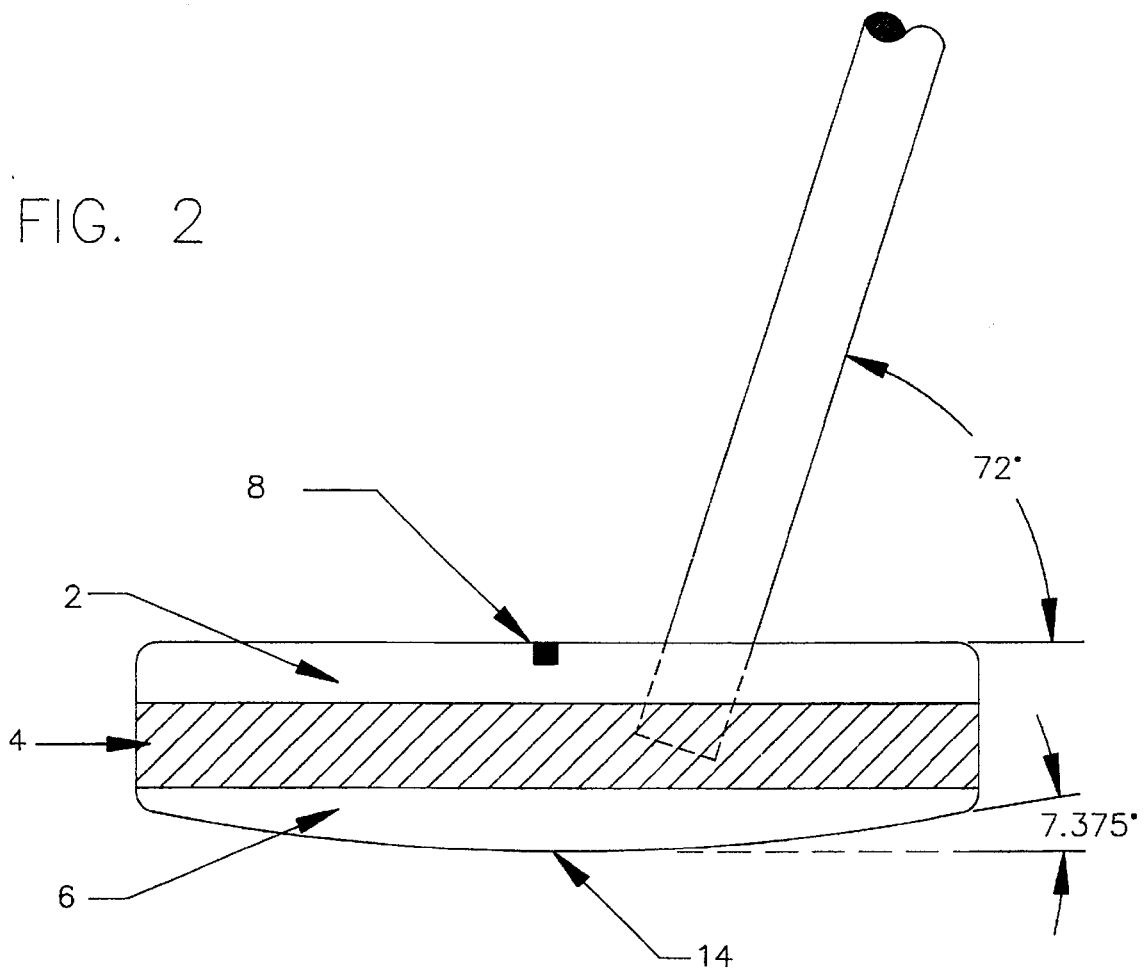
FIG. 2 is a side view of the putter head showing the solid surface horizontal line on the face, shaft insertion and the sole radius.

FIG. 2 shows a preferred embodiment of the formation of the single surface two dimensional alignment system 2,4,6, 8. While not illustrated, any means of assembly of contrasting colored pieces 2,4,6 of the same material to create a horizontal line on the face of the putter may be employed within the spirit of the present invention. In the preferred embodiment, the putter head may be manufactured by joining two or more pieces of the same material using epoxy or any bonding material that is compatible with the material used for the putter head. Optional placement of an alignment line 8 on the top of the putter head, over the "sweet spot" by any known means may be considered within the scope of the present invention. In the preferred embodiment, lines and holes are drilled/carved on top of the putter head over the "sweet spot." The cavities are filled with a material that is compatible with the material in the putter head, can be inlaid into the cavities in the putter head, creates a contrasting color with the top of the putter head, and does not distort the overall shape of the putter head. FIG. 2 also shows a preferred embodiment of the putter head with an arcuate curvature of the sole. This arcuate shape allows the golfer to adjust the hand position at address to the ball to a flatter or more upright position without increasing the area of contact between the sole of the putter head and the putting surface. Minimizing this contact area reduces the amount of drag or resistance if the golfer hits a "fat shot" (a fat shot is when the club hits or brushes the ground behind the ball before impact). Also, the arcuate shape provides similar benefits to the golfer when the ball may be putted but lies in taller grass surrounding the green (the "fringe"). In the preferred embodiment, the arcuate shape is formed through cutting, milling, sanding or molding the bottom component of the putter head to the specified number of degrees measured from the bottom center to the heel and to the toe of the putter head.

Figure 3:
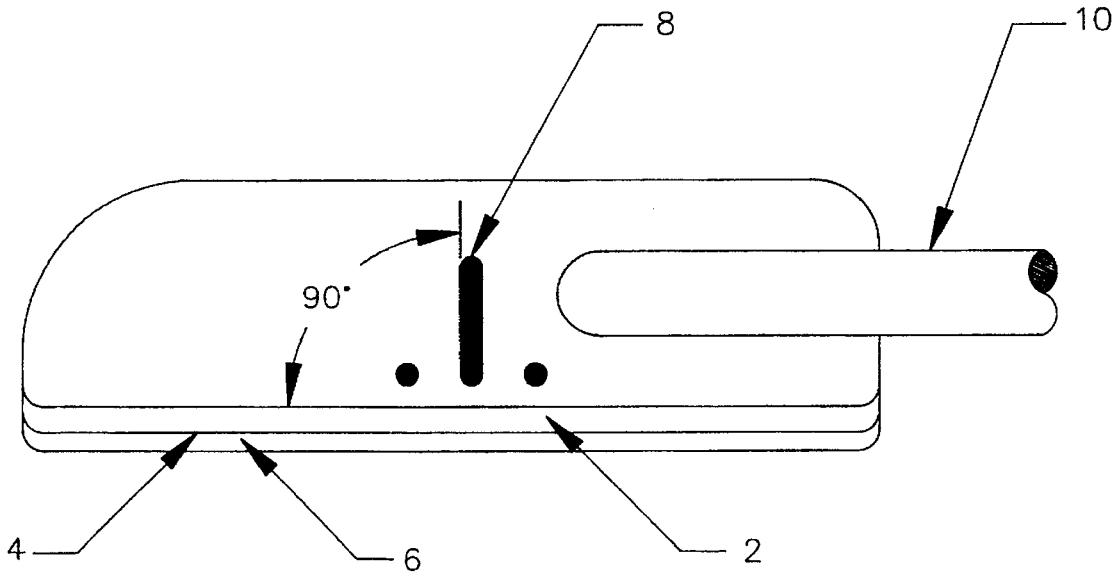
FIG. 3 is a top view of the putter head showing the two dimensional alignment system.

FIG. 3 demonstrates the principle of the single surface two dimensional alignment system in the preferred embodiment whereby the top alignment line 8 forms a visually perceived 90° angle with the thin visible horizontal contrasting line 4 on the face when the putter head is positioned correctly at the address of the golf ball. The visibility of the thin horizontal line 4 on the face is due to the loft of the club face. This concept is shown for the preferred embodiment in FIG. 6.

Figure 4:
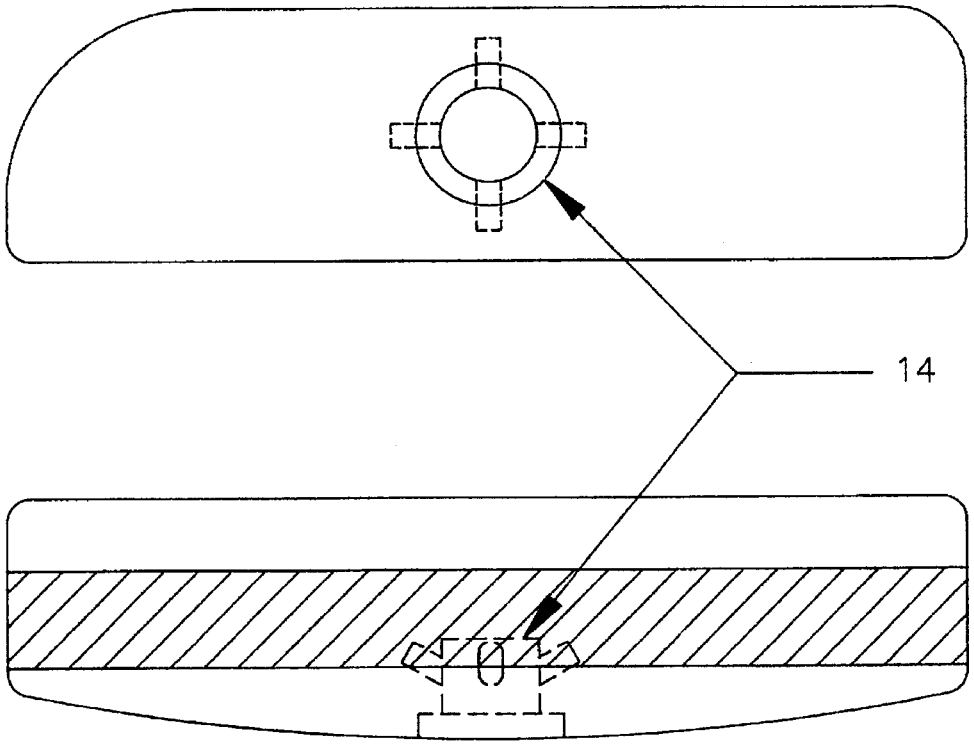
FIG. 4 is a bottom and side view of the present putter head invention showing the design and placement of the cavity for weight insertion.
Figure 5:
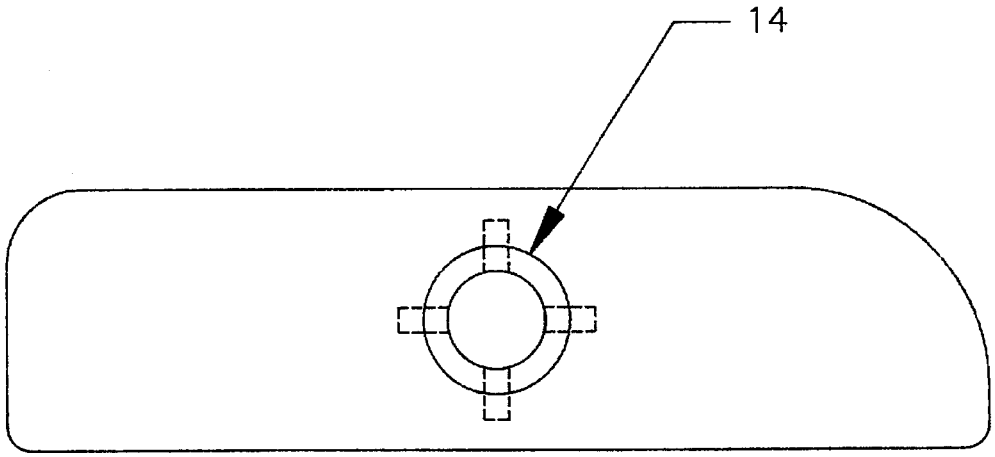
FIG. 5 is a bottom view of the putter head showing an external only view of the cavity for weight insertion.
Figure 6:
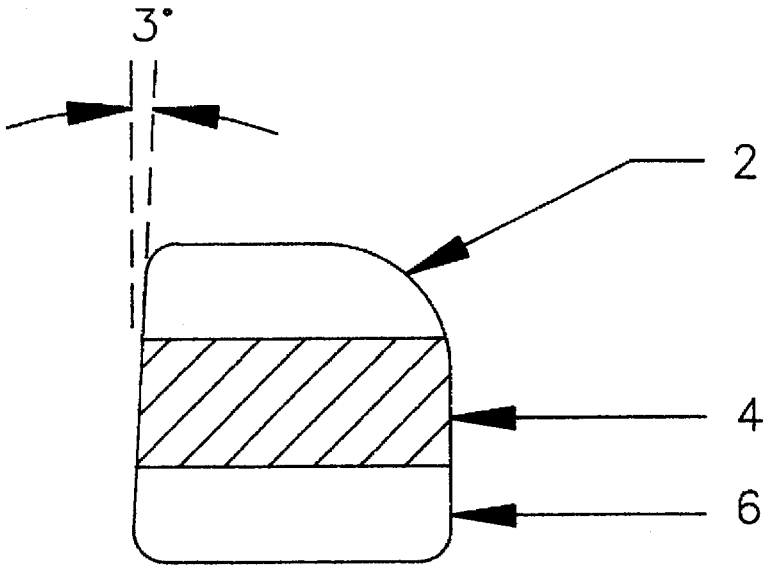
FIG. 6 is a view from the heel of the putter head showing the loft on the putter face required to produce the visually perceived component of the two dimensional alignment system.

FIGS. 4 and 5 show the design, placement, and outward appearance of the cavity 14 for weight insertion for the preferred embodiment. Although not illustrated, a cavity for weight insertion, created using any means, is considered within the scope of the present invention. In the preferred embodiment, the cavity 14 is created on the bottom of the putter head by drilling/carving an inner core for insertion of a molten liquid alloy (of greater density than the material used for the putter head) used to add additional mass to the putter head. Proximal to the surface of the bottom of the putter head, a larger diameter/width cavity with a depth that is sufficient to accommodate a cover and seal for the weight cavity is drilled/carved in a position to the original cavity 14 that creates concentricity. Small capillary type cavities are drilled/carved in a radial direction to the original cavity 14 to allow a molten liquid alloy to form an anchor within the subject cavity 14 upon solidification. The purpose of optimizing weight is to keep the putter head at a mass that imparts a good roll to the ball yet is not so heavy as to make the golfer execute too short a back swing or grip the club too tightly. Either or both actions result in incomplete strokes or putts that are too forceful.

Although not illustrated, the preferred embodiment of the putter head is made with a methyl methacrylate monomer and aluminum trihydrate by DuPont CORIAN®. This material imparts a "softer feel" than metal but has sufficient hardness to create a roll to the ball that has minimal skidding at impact. Reducing skid allows the ball to better roll on line toward the target. Prior art includes nonmetal materials, such as graphite, ceramics, and CORIAN; however, these materials have not been manufactured into a design that provides a single surface facial alignment system or a single surface two dimensional alignment system.

The preferred embodiment of the present invention combines a single surface two dimensional alignment system, weight optimization, reduced putter head-putting surface contact (reduced potential for drag), and a non-metal material in the putter head. These attributes produce a putter head and putter that offer the golfer the optimal conditions to aim, align, and execute an on line shot. These attributes also enable the golfer to utilize a longer back stroke on both long and short (less than three feet) putts, which allows for a pendulum-like stroke, enhances putting accuracy, and results in fewer putting strokes per round of golf.

This present invention, therefore, relates to a putter head comprising a club-head body having a front face; a top; a bottom or sole; a heel; a toe; and a rear wherein the front face has a ball striking surface with at least one visible horizontal element aligned in the center of the front face to form a single surface alignment aid and wherein the top has a shaft-receiver cavity between the sweet spot and the heel. The invention further relates to a putter head wherein the club-head body comprises a metallic or nonmetallic material. The present invention further comprises a putter head wherein the club-head body consists essentially of a synthetic polymeric material selected from CORIAN® (methyl mathacrylate monomer and aluminum trihydrate)from DuPont, or a similar synthetic solid acrylic polymer material such as those available from Formica, Nevamar or WilsonArt. The invention further relates to a putter head wherein at least two pieces of a nonmetallic solid material wherein said pieces form a visible horizontal line element in the center of the front face to form the single-surface alignment aid. The invention further comprises a putter head wherein the club-head body comprises three joined layers of a nonmetallic solid material, wherein the center layer of the three joined layers is the visible horizontal element aligned in the center of the front face to form the single-surface alignment aid. The invention further relates to a putter head wherein the club-head body comprises three joined layers of a nonmetallic solid material, wherein the nonmetallic material is selected from CORIAN® and further wherein said center layer is the visible horizontal element aligned in the center of the front face and said layer is a different color than the first or third layer to form the single-surface alignment aid. The invention further relates to a putter head wherein the top of the club head body contains an optional inlaid line at a 90° angle to the single surface alignment aid on the front face, and in combination with said single surface alignment aid, forms a two dimensional alignment system. The invention further relates to a putter head comprising a cavity on a nonstriking surface of the putter head wherein said cavity permits addition of a weight which adds additional mass to the putter head.

The present invention, therefore, relates to a golf putter comprising a club shaft selected from stainless steel, graphite, aluminum, wood, or titanium and gripping portion selected from leather, cork, rubber, or styrofoam at one end of said shaft; a putter head attached to the other end of said shaft via a shaft receiver cavity on the putter head wherein the putter head comprises a club-head body having a front-face ball striking surface, a top; a sole; a heel; a toe; and a rear, wherein the front face has at least one-visible horizontal element aligned in the center of the front face to form a single surface alignment aid and further wherein the top may optionally contain an inlaid line formed at a 90° angle to the horizontal alignment aid to form, in combination with said horizontal alignment aid, a two dimensional alignment system. The invention further relates to a golf putter wherein the putter head comprises a metallic or nonmetallic solid material. The invention further comprises a golf putter wherein the nonmetallic material is selected from CORIAN® (methyl methacrylate monomer and aluminum trihydrate) from DuPont, or similar synthetic solid acrylic polymer materials such as those available from Formica, Nevamar, or WilsonArt. The invention further relates to a golf putter wherein the club-head body comprises at least two attached pieces of a nonmetallic solid material wherein, for the two pieces, the horizontal line formed between the two attached pieces forms the visible horizontal element aligned in the center of the front face to form the single surface alignment aid. The invention further relates to a golf putter wherein the putter head may optionally contain a cavity on a nonstriking surface wherein said cavity permits addition of a weight which adds additional mass to the putter head. The invention further relates to a golf putter wherein the club-head sole may be curved to form an arcuate shape from the bottom center of the putter head to the bottom of the toe and the to the bottom of the heel of the putter head and the arcuate shape is less that or equal to 15° from the horizontal plane tangential to the bottom center the head to the bottom of the heel and toe but is greater than zero degrees. The invention further relates to a golf putter wherein the angle of the front-face striking surface of the club-head from the sole to the top of the head (loft) is greater than or equal to two degrees and less than or equal to seven degrees. The invention further relates to a golf putter wherein the front-face striking surface of the club-head is milled.

The present invention, therefore, relates to a method of Silk Touch™ putting whereas the method comprises utilizing a golf putter comprised of a club shaft selected from stainless steel, graphite, aluminum, wood, or titanium and gripping portion selected from leather, cork, rubber, or styrofoam at one end of said shaft; a putter head attached to the other end of said shaft via a shaft receiver cavity on the putter head wherein the putter head comprises a club-head body having a front-face ball striking surface, a top; a sole; a heel; a toe; and a rear, wherein the front face has at least one visible horizontal element aligned in the center of the front face to form a single surface alignment aid and further wherein the top may optionally contain an inlaid line formed at a 90° angle to the horizontal alignment aid to form, in combination with said horizontal alignment aid, a two dimensional alignment system to increase putting precision and accuracy. The present invention further relates to a method of Silk Touch™ putting, wherein the putter head comprises a nonmetallic solid material. The present invention further relates to a method of Silk Touch™ putting, wherein said nonmetallic material is selected from CORIAN®, This invention has been described in detail and refers to a preferred embodiment, but it will be understood that various other modifications may be effected by the spirit and scope of this invention.

What is claimed is:

1. A putter head comprising a club head body having front face ball striking surface; a top; a sole; a heel; a toe and a rear wherein the front face has at least one visible horizontal element aligned in the center of the front face to form a single-surface alignment aid and further wherein the top has a shaft receiver cavity positioned between the sweet spot on the front face and the heel to receive a shaft and the sole has a cavity for weight insertion directly behind the sweet spot.

2. A putter head according to claim 1 wherein the club head body comprises a metallic or nonmetallic solid material.

3. A putter head according to claim 2 wherein the nonmetallic solid material is selected from methyl methacrylate monomer and aluminum trihydrate.

4. A putter head according to claim 1 wherein the club head body comprises at least two pieces of a nonmetallic solid material wherein the line between said pieces forms the visible horizontal line element aligned in the center of the front face to form the single-surface alignment aid.

5. A putter head according to claim 1 wherein the club head body comprises three joined layers of a nonmetallic solid material wherein the center layer of the three joined layers forms a visible horizontal element aligned in the center of the front face to form a single-surface alignment aid.

6. A putter head according to claim 5 wherein the nonmetallic solid material is selected from a methyl methacrylate monomer and aluminum trihydrate.

7. A putter head according to claim 5, wherein the top of the club head body contains an inlaid line at a 90° angle to the single surface alignment aid on the front face, and in combination with said single surface alignment aid, forms a two dimensional alignment system.

8. A putter head according to claim 1 wherein said cavity permits addition of a weight which adds additional mass to the putter head and wherein said weight is a molten liquid alloy which forms an anchor within the cavity and small capillary type cavities upon solidification.

9. A golf putter comprising a club shaft and gripping portion at one end of said shaft; a putter head attached to the other end of said shaft via a shaft receiver cavity on the putter head wherein the putter head comprises a club head body having a front face ball striking surface with a sweet spot; a top; a sole wherein said sole has a cavity for weight insertion and said cavity is located directly behind the sweet spot; a heel; a toe; and a rear, wherein the front face has at least one visible horizontal element aligned in the center of the front face to form a single surface alignment aid and further wherein the top containing an inlaid line formed at a 90° angle to the horizontal alignment aid to form, in combination with said horizontal alignment aid, a two dimensional alignment system.

10. A golf putter according to claim 9, wherein the putter head comprises a metallic or nonmetallic solid material.

11. A golf putter according to claim 10, wherein the nonmetallic material is selected from a methyl methacrylate monomer and aluminum trihydrate.

12. A golf putter according to claim 9, wherein the club head body comprises at least two attached pieces of a nonmetallic solid material wherein, for the two pieces, the horizontal line formed between the two attached pieces forms the visible horizontal element aligned in the center of the front face to form the single surface alignment aid.

13. A golf putter according to claim 9 wherein said cavity permits addition of a weight which adds additional mass to the putter head and wherein said weight is a molten liquid alloy which forms an anchor within the cavity and small capillary type cavities upon solidification.

14. A golf putter according to claim 9, wherein the sole curved to form an arcuate shape from a bottom center of the putter head to a bottom center of the toe and to a bottom center of the heel of the putter head and the arcuate shape is less than or equal to 15° from the horizontal plane tangential to the bottom center of the putter head to the bottom of the heel and toe but is greater than zero degrees.

15. A golf putter according to claim 9, wherein the angle of the front face ball striking surface from the sole to the top of the head (loft) is greater than or equal to two degrees and less than or equal to seven degrees.

16. A golf putter according to claim 9, wherein the front face ball striking surface is milled.

17. A method of putting, comprising putting a golf putter comprised of a club shaft and gripping portion at one end of said shaft; a putter head attached to the other end of said shaft via a shaft receiver cavity on the putter head wherein the putter head comprises a club head body having a front face ball striking surface with a sweet spot, a top; a sole wherein the sole has a cavity for weight insertion directly behind the sweet spot; a heel; a toe; and a rear, wherein the front face has at least one visible horizontal element aligned in the center of the front face to form a single surface alignment aid and further wherein the top contains an inlaid line formed at a 90° angle to the horizontal alignment aid to form, in combination with said horizontal alignment aid, a two dimensional alignment system.

18. A method of putting according to claim 17, wherein said putter head comprises a nonmetallic solid material.

19. A method of putting according to claim 18, wherein said nonmetallic solid material is selected from a methyl methacrylate monomer and aluminum trihydrate.

* * * * *